United States Patent [19]

Hibino et al.

[11] 4,288,198

[45] Sep. 8, 1981

[54] METHOD OF CONTROLLING MULTISTAGE CENTRIFUGAL COMPRESSOR EQUIPMENT

[75] Inventors: Yozo Hibino; Junichi Oizumi; Hideo Nishida; Yoshiyuki Nakano; Hiroshi Ohmachi, all of Shimoinayoshi, Japan

[73] Assignee: Hitachi, Ltd., Tokyo, Japan

[21] Appl. No.: 94,733

[22] Filed: Nov. 15, 1979

[30] Foreign Application Priority Data

Mar. 12, 1979 [JP] Japan ..... 54-27744

[51] Int. Cl.[3] ..... F04D 15/00

[52] U.S. Cl. ..... 415/1; 415/17; 415/149 R

[58] Field of Search ..... 415/1, 17, 26, 149 R; 364/505, 509, 510, 511

[56] References Cited

U.S. PATENT DOCUMENTS

| | | | |
|---|---|---|---|
| 2,645,410 | 7/1953 | Bauger et al. | 415/149 R |
| 3,362,624 | 1/1968 | Endress | 415/149 R |
| 3,362,625 | 1/1968 | Endress | 415/149 R |
| 3,799,694 | 3/1974 | Duzan | 415/149 R |
| 3,930,746 | 1/1976 | Kronogard | 415/149 R |

*Primary Examiner*—Louis J. Casaregola

*Attorney, Agent, or Firm*—Craig and Antonelli

[57] ABSTRACT

A method of controlling the operation of multistage centrifugal compressor equipment provided with inlet guide vanes and diffuser vanes at each stage to enable operation to be practiced at a low energy consumption level. The method includes the steps of determining whether the prevailing flow rate, for example, is in a range of flow rates near the desired flow rate or in a range of flow rates remote therefrom; and controlling a combination of the amount of operation of the guide vanes with the amount of operation of the diffuser vanes, which is set beforehand, when the prevailing flow rate is determined to be in the latter range to promptly bring the prevailing flow rate to the desired flow rate level, and effecting fine adjustments of the inlet guide vanes and diffuser vanes to control the angles thereof when the prevailing flow rate is determined to be in the former range, thereby enabling increased efficiency to be achieved in the operation of the compressor equipment.

3 Claims, 5 Drawing Figures

METHOD OF CONTROLLING MULTISTAGE CENTRIFUGAL COMPRESSOR EQUIPMENT

BACKGROUND OF THE INVENTION

1. Field of the Invention

This invention relates to methods of controlling multistage centrifugal compressor equipment provided with inlet guide vanes and diffuser vanes at each stage, and more particularly it is concerned with a method of controlling multistage centrifugal compressor equipment such that desired operating conditions can be promptly obtained and high efficiency can be achieved in the desired operating conditions.

2. Description of the Prior Art

Proposals have hitherto been made to effect adjustments of the capacity or the flow rate and practice operation of saving energy in conventional compressors of the centrifugal type by adjusting the angles of inlet guide vanes and diffuser vanes. Such centrifugal compressors are disclosed, for example, in U.S. Pat. Nos. 3,362,624 and 3,362,625. Generally, there are two methods available for controlling the amounts of operation of these vanes. One method includes adjusting the operation of the vanes to bring the prevailing flow rate of handled medium into agreement with the desired flow rate while the operatore watches the condition in which the medium is sucked into the compressor and the load at which the compressor operates. The other method includes detecting the operating condition of the compressor and controlling the vanes in a manner to bring the flow rate of the working medium to the desired level by control means including a detector, a controller and a driver and determining the amount of operation of the vanes by an adjusting means in accordance with a signal processing system prepared beforehand.

Meanwhile proposals have also been made to use a multistage compressor system including inlet guide vanes and diffuser vanes provided at each stage, the inlet guide vanes and the diffuser vanes being operated in an orderly manner to achieve high efficiency in operation over a large range of flow rates. For example, in the case of a four-stage compressor system, the inlet guide vanes and diffuser vanes are mounted in eight positions altogether because they are provided at each stage. In this type of compressor system, difficulties have been encountered in effecting control of the operation of the inlet guide vanes and diffuser vanes by the conventional methods described hereinabove to attain the desired flow rate promptly and to achieve high efficincy under all operating conditions in a greater range of flow rates than heretofore experienced, because of the multiplicity of the positions in which the vanes to be controlled are located and the complexity of the mechanism involved in effecting control and nonlineality of relations between the angles of vanes and the operating conditions. Thus it has become necessary to design beforehand a method of control which is complex enough to replace the aforesaid methods of control of the prior art.

SUMMARY OF THE INVENTION

An object of the present invention is to provide a method of controlling multistage centrifugal compressor equipment provided with inlet guide vanes and diffuser vanes mounted at each stage, which method is capable of maintaining the efficiency of operation of the compressor equipment at a high level over a large range of operating conditions by adjusting the angle of these vanes.

Another object is to provide a method of controlling multistage centrifugal compressor equipment of the type described, which method enables the compressor equipment to operate at a low energy consumption level.

In order to accomplish the aforesaid objects, according to the present invention, there is provided a method of controlling multistage centrifugal compressor equipment having inlet guide vanes and diffuser vanes mounted at each stage in variable angle position, the method comprising the steps of determining which one of a range of operating conditions near the desired operating conditions and a range of operating conditions remote from the desired operating conditions the prevailing operating conditions of the compressor equipment are in; and controlling a combination of the amount of operation of the inlet guide vanes with the amount of operation of the diffuser vanes, which is determined beforehand, along an operating line of the compressor equipment so as to bring the prevailing operating condtions to the range of operating conditions near the desired operating conditions when the prevailing operating conditions are determined to be in the range of operating conditions remote from the desired operating conditions, and effecting fine adjustments of the inlet guide vanes and diffuser vanes to shift the efficiency of operation to a higher level within a range that the prevailing operating conditions do not deviate from the desired operating conditions when the prevailing operating conditions are determined to be in the range of operating conditions near the desired operating conditions.

Additional and other objects, features and advantages of the present invention will become apparent from the description set forth hereinafter when considered in conjunction with the accompanying drawings.

DESCRIPTION OF THE PREFERRED EMBODIMENT

Figure 1:
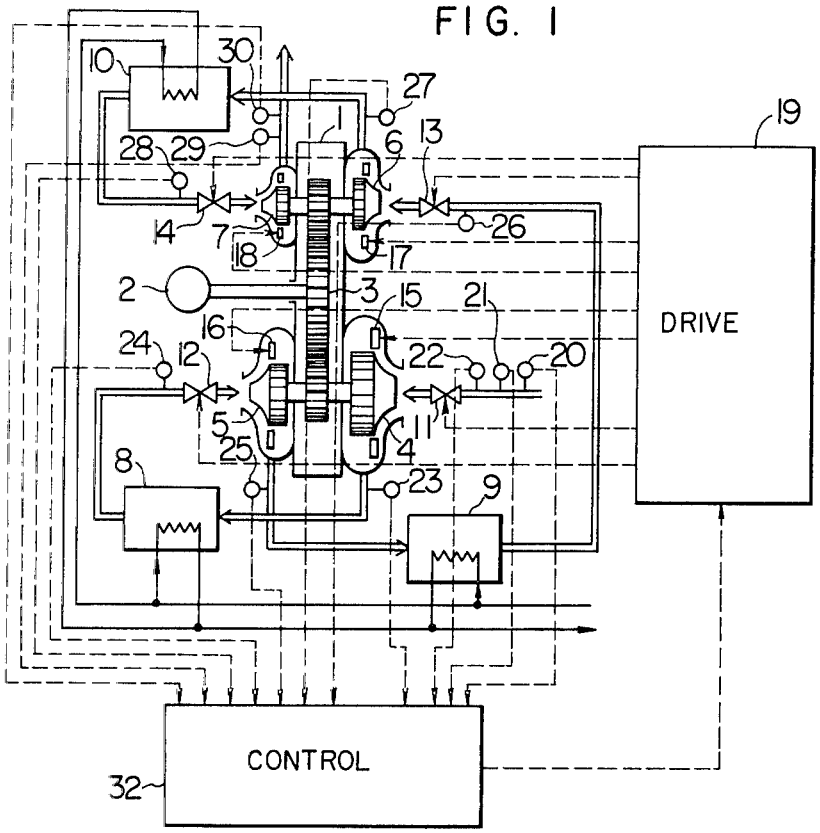
FIG. 1 is a schematic view of one example of the construction of multistage centrifugal compressor equipment to which the method of control according to the invention can be applied.

FIG. 1 shows the construction of one example of the multistage centrifugal compressor equipment 1 in which the method of control according to the invention can have application. As shown, the centrifugal compressor equipment comprises a first stage compressor 4, a second stage compressor 5, a third stage compressor 6 and a fourth stage compressor 7 which are all driven by an electric motor 2 and a gear 3, a first stage intermediate cooler 8, a second stage intermediate cooler 9 and a third stage intermediate cooler 10. Air sucked through a suction port of the first stage compressor 4 is successively compressed and cooled at the first to fourth stage compressors 4–7 and the first to third intermediate cooler 8–10 respectively, and delivered through a discharge port of the fourth stage compressor 7 to a processing station of the plant which is the load applied to the compressor equipment.

Inlet guide vanes 11, 12, 13 and 14 are each mounted on the inlet side of one of the four stage compressors 4–7. By adjusting the angle of one set of these guide vanes, it is possible to adjust the conditions of air introduced into each stage compressor. Meanwhile diffuser vanes 15, 16, 17 and 18 are then mounted on the outlet side of one of the four stage compressors 4–7. By adjusting the angle of one set of these diffuser vanes, it is possible to adjust the conditions of air discharged from each stage compressor. These vanes 11–18 are connected to a drive 19 so as to be operated and set at any angle as desired by a respective drive element of the drive 19. The conditions of air flowing into the first stage compressor 4 or the flow rate, pressure and temperature thereof are detected by a flow rate detector 20, a temperature detector 21 and a pressure detector 22 respectively. The temperature of air flowing out of the first stage compressor 4 is detected by a temperature detector 23. The temperatures of air flowing into and out of the second stage compressor 5 are detected by temperature detectors 24 and 25 respectively. The temperatures of air flowing into and out of the third stage compressor 6 are detected by temperature detectors 26 and 27 respectively. The temperature of air flowing into the fourth stage compresor 7 is detected by a temperature detector 28, and the temperature and pressure of air flowing out of the fourth stage compressor 7 are detected by a temperature detector 29 and a pressure detector 30 respectively. Interposed between the detectors 20–30 and drive 19 is control 32 for practicing the method of control according to the invention. Signals from the detectors 20–30 are inputted to the control 32. The method of control practiced by the control 32 will now be described in detail.

Figure 2:
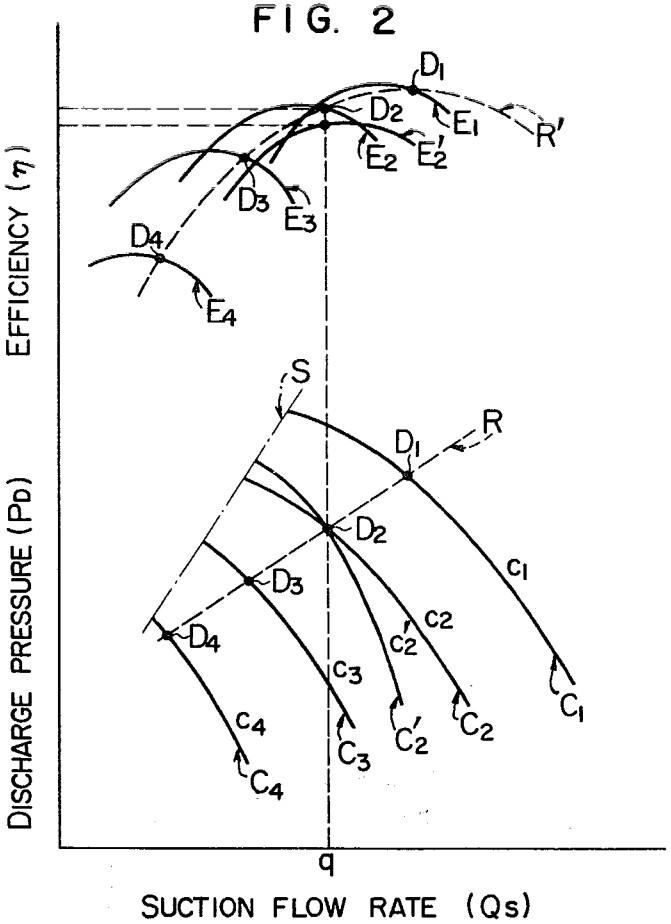
FIG. 2 is a diagrammatic representation of the characteristics of the centrifugal compressor equipment shown in FIG. 1.

FIG. 2 is a diagram showing the characteristics of the centrifugal compressor equipment shown in FIG. 1. In the figure, the abscissa represents a suction flow rate Qs, and the ordinate indicates a discharge pressure $P_D$. One of inlet volumetric flow and mass flow and so forth may be used for flow rate and one of isothermal head and ratio of compression and so forth may be used for discharge pressure. The conditions of the compressor equipment are represented by rightwardly downwardly inclined curves $C_1$ to $C_4$. These curves $C_1$ to $C_4$ correspond to $c_1$, $c_2$, $c_3$ and $c_4$ which represent combinations of the amount of operation of each set of the inlet guide vanes 11–14 with the amount of operation of each set of the diffuser vanes 15–18 respectively. Here, a combination of the amount of operation of each set of inlet guide vanes with the amount of operation of each set of diffuser vanes is expresed by $c=(v_1, v_2, v_3, v_4, d_1, d_2, d_3, d_4)$ by using the angles $v_1$, $v_2$, $v_3$ and $v_4$ of the inlet guide vanes 11–14 of the four stages respectively and the angles $d_1$, $d_2$, $d_3$ and $d_4$ of the diffuser vanes 15–18 of the four stages respectively. The efficiency denoted by $\eta$ which corresponds to each of the curves $C_1$ to $C_4$ is represented by each of curves $E_1$ to $E_4$ which are convex in shape as shown in the upper part of FIG. 2. One of isothermal efficiency and polytropic efficiency and so forth may be used for efficiency. A load resistance, such as a plant which is connected to the discharge side of the compressor equipment of the characteristics described hereinabove, can be expressed as a resistance curve R shown in FIG. 2 which is an operating line of the compression equipment.

In FIG. 2, when the flow rate is set according to the plant operating condition, the discharge pressure of the compressor equipment is determined by the intersection of the flow rate curves with the resistance curve R. There are a plurality of combinations of the amount of operation of the inlet guide vanes 11–14 with the amount of operation of the diffuser vanes 15–18 that satisfy the resistance curve R, and efficiency varies depending on what combination is selected. For example, there are two combinations $c_2$ and $c_2'$ of the amount of operation of the inlet guide vanes 11–14 with the amount of operation of the diffuser vanes 15–18 that provide a uniform discharge pressure at a flow rate q. The efficiencies corresponding to the combinations $c_2$ and $c_2'$ are represented by curves $E_2$and $E_2'$ respectively, with the efficiency $E_2$ being higher than the efficiency $E_2'$, when the flow rate is q. This means that higher efficiency can be achieved with the combination $c_2$ than with the combination $c_2'$. The aforesaid combinations $c_1$, $c_2$, $c_3$ and $c_4$ of the amount of operation are decided upon as the combinations of the amount of operation of the inlet guide vanes 11–14 with the amount of operation of the diffuser vanes 15–18 that maximize efficiency at all times at the particular flow rate along the resistance curve R. In the compressor equipment having the aforesaid load resistance applied thereto, operation of the compressor equipment that is practiced along the resistance curve R with the predetermined amount of operation meets the specifications of the plant with respect to compressed air and has high efficiency.

In FIG. 2, R' is a resistance curve associated with efficiency curves that are obtained when the intersections $D_1$ to $D_4$ of the resistance curve R are brought into association with the efficiency curves $E_1$ to $E_4$. S is a surging initiating line. Based on the characteristics curves shown in FIG. 2, it is possible to prepare a control table in which a combination of the amount of operation of the inlet guide vanes 11–14 with the amount of operation of the diffuser vanes 15–18 corresponds to a suction flow rate Qs. Thus in actual operation, the predetermined efficiency that is represented by the efficiency curves at the upper portion of FIG. 2 can be achieved if the combination c of the amount of operation corresponding to the sunction flow rate $Q_s$ is selected and control of the vanes is effected accordingly.

An example of the control table described hereinabove will be explained in concrete terms. In one type of such control table, the angles of the inlet guide vanes 11–14 and the angles of the diffuser vanes 15–18 of each stage are obtained from a functional relation set beforehand with respect to the operation of the compressor equipment, and control of the vanes is effected based on these angles. The functional relation is shown in Table 1.

TABLE 1

| Operating Conditions | Amount of Operation |
|---|---|
| Air flow Rate, Pressure, Temperature and so forth | Angles of inlet guide vanes and diffuser vanes at each stage |
| a | $v_{10} = f_1(a)$, $v_{20} = f_2(a)$, $v_{30} = f_3(a)$, $v_{40} = f_4(a)$, $d_{10} = f_5(a)$, $d_{20} = f_6(a)$, $d_{30} = f_7(a)$, $d_{40} = f_8(a)$ |
| b | $v_{11} = f_1(b)$, $v_{21} = f_2(b)$, $v_{31} = f_3(b)$, $v_{41} = f_4(b)$, $d_{11} = f_5(b)$, $d_{21} = f_6(b)$, $d_{31} = f_7(b)$, $d_{41} = f_8(b)$ |

In this table,
$f_1$: function for obtaining angle $v_1$ of first stage inlet guide vanes 11;
$f_2$: function for obtaining angle $v_2$ of second stage inlet guide vanes 12;
$f_3$: function for obtaining angle $v_3$ of third stage inlet guide vanes 13;
$f_4$: function for obtaining angle $v_4$ of fourth stage inlet guide vanes 14;
$f_5$: function for obtaining angle $d_1$ of first stage diffuser vanes 15;
$f_6$: function for obtaining angle $d_1$ of second stage diffuser vanes 16;
$f_7$: function for obtaining angle $d_3$ of third stage diffuser vanes 17; and
$f_8$function for obtaining angle $d_4$ of fourth stage diffuser vanes 18

These functions are of the nature such that they are obtained prior to or at initial stages of operation of centrifugal compressor equipment. By deciding upon these functions beforehand and storing them as the control table, it is possible to readily obtain amounts of operation of the inlet guide vanes 11–14 and diffuser vanes 15–18 as changes may occur in the operating conditions of the compressor equipment. For example, when the operating conditions are set as being a shown in Table 1, various amounts of operation can be determined based on the functional relation $f_1$–$f_8$ corresponding to the operating conditions a. Control of the inlet guide vanes 11–14 and diffuser vanes 15–18 is effected according to these amounts of operation. Upon the operating conditions being changed to b, amounts of operation of the vanes can be obtained based on the corresponding functional relation in the same manner as described hereinabove.

The control table shown in Table 1 will be described further in the concrete by referring to Table 2.

TABLE 2

| Suction Flow Rate | Angles of Inlet Guide Vanes and Diffuser Vanes of Each Stage |
|---|---|
| a | $v_{10} = v_{20} = v_{30} = v_{40} = A$ $d_{10} = d_{20} = d_{30} = d_{40} = A'$. |
| b | $v_{11} = v_{21} = v_{31} = v_{41} = B$. $d_{11} = d_{21} = d_{31} = d_{41} = B'$. |

In Table 2, the operating conditions are represented by suction flow rate, in the interest of brevity. For each suction flow rate, the equal values are chosen for the angles of the inlet guide vanes 11–14 and the angles of the diffuser vanes 15–18 respectively. That is, for the flow rate a, a value A is chosen for the angles $v_{10}$, $v_{20}$, $v_{30}$ and $v_{40}$ of the inlet guide vanes 11–14, and a value A' is chosen for the angles $d_{10}$, $d_{20}$, $d_{30}$ and $d_{40}$ of the diffuser vanes 15–18. By selecting the relation described hereinabove, it is possible to simplify the process and means for determining the amount of operation. To this end, one has only to set a suction flow rate as representing operating conditions and to choose one of the predetermined amounts of operation in accordance with the desired flow rate. In actual practice, it is possible to satisfy the specifications by using the control method described hereinabove. When the specifications are more demanding, it is possible to provide a more sophisticated control table by rendering the operating conditions more complex and selecting functions of higher precision.

The functional relation described hereinabove has been shown to be obtained prior to or at early stages of initial operation of compressor equipment. However, when changes with time or variations in conditions of load applied to the compressor equipment occur, it may happen that the aforesaid functional relation does not satisfy specifications. When this is the case, the functional relation based on the aforesaid operating conditions is revised. If necessary, the amount of operation is determined in accordance with the difference between the prevailing flow rate and the desired flow rate when the prevailing flow rate is satisfactorily near the desired flow rate.

In actual practice, compressor equipment is generally operated continuously over a prolonged period of time. Because of this, it is inevitable that changes with time or deterioration in performance occur, even if the characteristics curves and a control table are prepared accurately when new centrifugal compressor equipment is installed. This would give rise to the failure that even if control is effected based on the control table, predetermined efficiency might not be achieved when the desired flow rate is attained. Thus, according to the invention, the suction flow rate is determined whether it is in a range of flow rates near the desired flow rate which may vary depending on changes in the load applied to the compressor equipment or in a range of flow rates remote from the desired flow rate, and separate control processes are used for controlling various combinations of the amount of operation of the vanes in accordance with the aforesaid determination of the suction flow rate.

It can readily be determined which of the two ranges the suction flow rate is in by using, for example the following equation with respect to the flow rate $Q_s$ which is then prevailing.

$$|Q_s - Q_{sp}| < \epsilon(Q_{sp}) \quad (1)$$

where $Q_{sp}$ is the desired flow rate, and $\epsilon(Q_{sp})$ is the parameter for setting the boundary between the two ranges which may be set when control is carried out.

If the suction flow rate is in a range of flow rates remote from the desired flow rate which does not let equation (1) hold, then the amounts of operation of the vanes are selected in accordance with the suction flow rate which varies moment by moment as it draws near the desired flow rate with respect to changes in the amount of operation and in the load applied to the compressor equipment by using information contained in a control table prepared by taking into consideration the facts that the suction flow rate should be brought to the desired flow rate as soon as possible, that efficiency of the compressor equipment should be maintained at a high level in the process in which the desired flow rate is attained, and that the same control performance should be maintained no matter what the level of the desired flow rate may be. The selected amount of operation is fed to the drive 19 to control the inlet guide vanes 11–14 and diffuser vanes 15–18.

If the suction flow rate is in a range of flow rates near the desired flow rate which lets equation (1) hold or it is introduced into such range of flow rates, then the operating conditions can be considered to be such that the desired flow rate is attained. However, as described hereinabove, efficiency may not be at the highest level attainable even if the desired flow rate is attained. Stated differently, efficiency could be improved. Thus the control process described hereinabove is not complete without some other control process which could be used for controlling the combination of the amounts of operation of the vanes in such a manner that once the desired flow rate is attained with the equation (1) holding, the current state of operation could shift to a state of operation of higher efficiency after such state of operation is detected. One example of this control process will be described by referring to FIG. 3, wherein the operating conditions in which equation (1) holds are shown at a point P and the combination of the amount of operation of the inlet guide vanes 11–14 with the amount of operation of the diffuser vanes 15–18 is expressed by the following formula: $cp=(v_p, d_p)=(v_{1p}, v_{2p}, v_{3p}, v_{4p}, d_{1p}, d_{2p}, d_{3p}, d_{4p})$. The correction to be made in this combination of amounts is expressed by the following formula: $\Delta v=(\Delta v_1, \Delta v_2, \Delta v_3, \Delta v_4)$, $\Delta d=(\Delta d_1, \Delta d_2, \Delta d_3, \Delta d_4)$, In FIG. 3, the abscissa represents $\Delta v$, and the ordinate indicates $\Delta d$. If point P is taken as the origin, a point may exist at which efficiency is higher than at point P as indicated by the contour lines showing efficiency, in view of the general continuous characteristics of compressor equipment. Thus, when the flow rate is in a range of flow rates near the desired flow rate, control is effected in such a manner that point P shifts to a point of higher efficiency. More specifically, of the combination of the amount of operation $cp=(v_p, d_p)$ at point P, the angles of the inlet guide vanes 11–14 for all the stages are first increased by $\Delta v$ and efficiency is determined after the increase. If the efficiency determined is higher than the efficiency at point P, then the inlet guide vanes 11–14 of all the stages are controlled by using the amount of correction of $\Delta v$. If the efficiency determined is lower than the efficiency at point P, then the angles of the inlet guide vanes 11–14 of all the stages are reduced below the angles at point P by $\Delta v$ and efficiency is determined following the reduction. When the efficiency determined is higher than that at point P, the inlet guide vanes 11–14 of all the stages are controlled by using the amount of correction of $\Delta v$. When efficiency shows no increase even if the angles of the inlet guide vanes 11–14 of all the stages are increased or reduced by $\Delta v$, the angles of the diffuser vanes 15–18 of all the stages are increased by $\Delta d$ and efficiency is determined after the increase. If the efficiency determined is higher than that at point P, then the diffuser vanes 15–18 are controlled by using the amount of correction of $\Delta d$. If the efficiency determined is lower than that at point P, then the angles of the diffuser vanes 15–18 are reduced below the angles at point P by $\Delta d$ and efficiency is determined following the reduction. When the efficiency determined is higher than that at point P, the diffuser vanes 15–18 are controlled by using the amount of correction of $\Delta d$. In the event of efficiency showing no increase as a result of correcting the amounts of operation of the vanes in four directions as aforesaid, increased efficiency may be achieved by reducing the amount of correction of $\Delta v$ or $\Delta d$ for the amount of operation and by effecting control as described hereinabove. If all the aforesaid trials of searching a point of higher efficiency than point P fail, then point P is judged to be the point of highest efficiency. By sequentially searching a point of higher efficiency and correcting the amount of operation of the vanes in four direction as described hereinabove, it is possible to cause the state of operation to shift to a state in which efficiency is higher than at point P.

Figure 3:
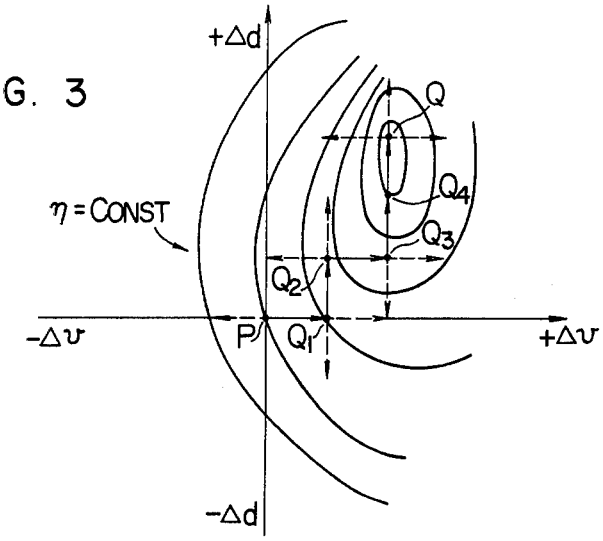
FIG. 3 is a view in explanation of the manner in which control is effected to bring about a condition in which the compressor equipment can be operated with high efficiency by using the method of control according to the invention.

The aforesaid process for searching a point of higher efficiency will now be described in detail by referring to FIG. 3. A point at which efficiency is increased when the angles of the inlet guide vanes 11–14 are increased by $\Delta v$ above the angles at point P is indicated at $Q_1$. Then, searching of a point of higher efficiency is carried out with respect to the combination of the amount of operation $c_{q1}=(v_p+\Delta d, d_p)$ at point $Q_1$ in the same manner as searching of a point of higher efficiency has been carried out with respect to the corresponding combination of the amount of operation at point P. If increased efficiency relative to the efficiency at point $Q_1$ is achieved as the result of an increase incorporated in the angles of the diffuser vanes 15–18 by $\Delta d$, a point of operation controlled by the amount of correction of $\Delta d$ is indicated at $Q_2$. Likewise, a point of operation $Q_3$ may be obtained by increasing the angles of the inlet guide vanes 11–14 by $\Delta v$ at point $Q_2$, and a point of operation $Q_4$ may be obtained by increasing the angles of the diffuser vanes 15–18 by $\Delta d$ at point $Q_3$. Then a point of operation Q of the compressor equipment may be obtained by increasing the angles of the diffuser vanes 15–18 by $\Delta d$ at point $Q_4$. If no increase in efficiency is achieved by increasing or reducing the angles of the inlet guide vanes 11–14 by $\Delta v$ or by increasing or reducing the angles of the diffuser vanes 15–18 by $\Delta d$ at point Q, then point Q can be considered to be in the state of operation of highest efficiency. It will not be necessary to state that the existance of the equation (1) is the preamble for realization of this state of operation of highest efficiency.

In the embodiment shown and described hereinabove, a process for searching operating conditions of increased efficiency is described in which four amounts of correction represented by $\Delta v$ and $\Delta d$ are used for successively varying the angle of the vanes. However, the invention is not limited to this process, and alternatively an arrangement may be made to maintain a predetermined relation between the four amounts of correction and to effect control based on this relation.

In practicing a control operation in accordance with this control process, there are several decisions that should be made. They include decisions on the absolute amounts of correction of $\Delta v$ and $\Delta d$ for the amount of operation of the vanes, on the relative ratio of the amount of correction for one stage to the amount of correction for another stage determined by the aforesaid absolute amounts of correction, on the order in which searching is carried out, on the criteria of judging the case where no increase in efficiency is achieved, on whether or not the adoption of a new correcting process is necessary, and on the judgements to be passed when a point of the maximum efficiency is reached. These decisions are made by taking into consideration the performance of detecting means and the driving means and the function and performance of the control for practicing this control process, in addition to the characteristics of the compressor equipment described hereinabove.

Figure 4:
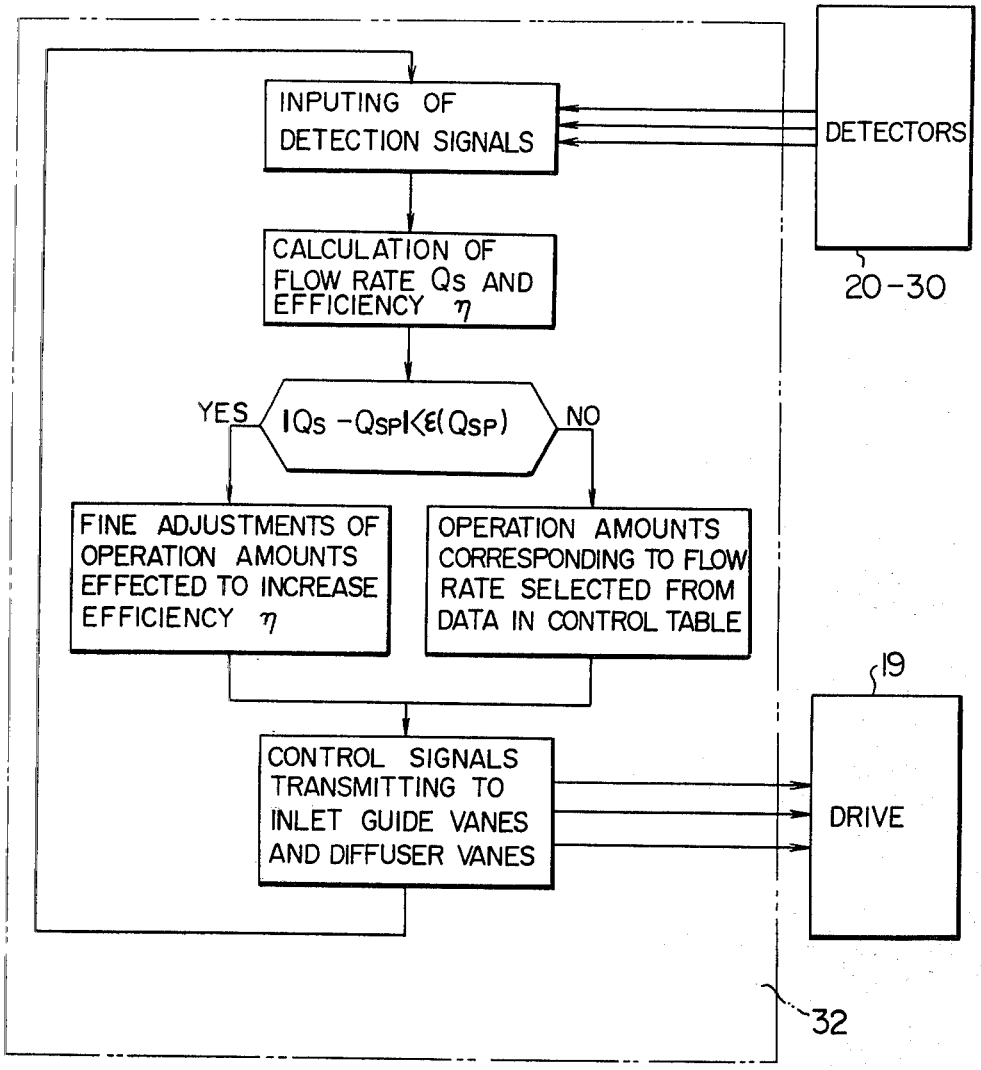
FIG. 4 is a flow chart showing the processing operation performed by a control device used in practicing the method of control according to the invention.

The control process described hereinabove is put into practice by instructions with regard to the performance of a processing operation given by the control 32. FIG. 4 shows a flow chart of the processing operation performed by the control 32. In FIG. 4, parts similar to those shown in FIG. 1 are designated by like reference characters.

A control operation practiced by using the aforesaid control process according to the invention will be described by referring to FIG. 4. In FIG. 4, signals from detectors 20–30 are inputted to the control 32 which calculates suction flow rate $Q_s$ and efficiency $\eta$ prevailing at this point in time based on these signals. The flow rate obtained in this way is compared with a desired flow rate to judge whether the relation represented by equation (1) holds. When the equation (1) is in the negative, an amount of operation corresponding to the desired flow rate is selected from the data set and stored beforehand in a control table and supplied to the drive 19 which accordingly drives the inlet guide vanes 11–14 and diffuser vanes 15–18, thereby causing the flow rate to shift to the desired flow rate. Upon a variation in the flow rate occuring, the combination of the amount of operation is selected in accordance with the current flow rate to control the vanes successively so that the flow rate will change toward the desired flow rate. Thus it is possible to achieve the desired flow rate if the vanes are controlled in this amount of operation, regardless of whether or not there is a variation in the load applied to the compressor equipment. According to this control system, the operating point shifts along the resistance curve R, so that it is possible to avoid dangerous situations, such as surging or choking.

Now let us assume that the comparison of the flow rate with the desired flow rate has found that equation (1) holds. Then, the amount of operation for correcting the angle of the vanes in a manner to increase efficiency $\eta$ as shown in FIG. 3 is determined. The amount of operation determined in this way is supplied as a control signal from the control 32 to the drive 19. As a result, the inlet guide vanes 11–14 and diffuser vanes 15–18 of each stage have their angles varied to obtain the determined amount of operation. This series of control actions enables prompt capacity adjustments to be effected in accordance with a change in the desired flow rate and by following up any change in the operating conditions of the compressor equipment which may be caused by a variation in the load applied thereto or a change in environmental conditions, and is repeated in cycle for a necessary number of times for maintaining the compressor equipment at high efficiency.

Figure 5:
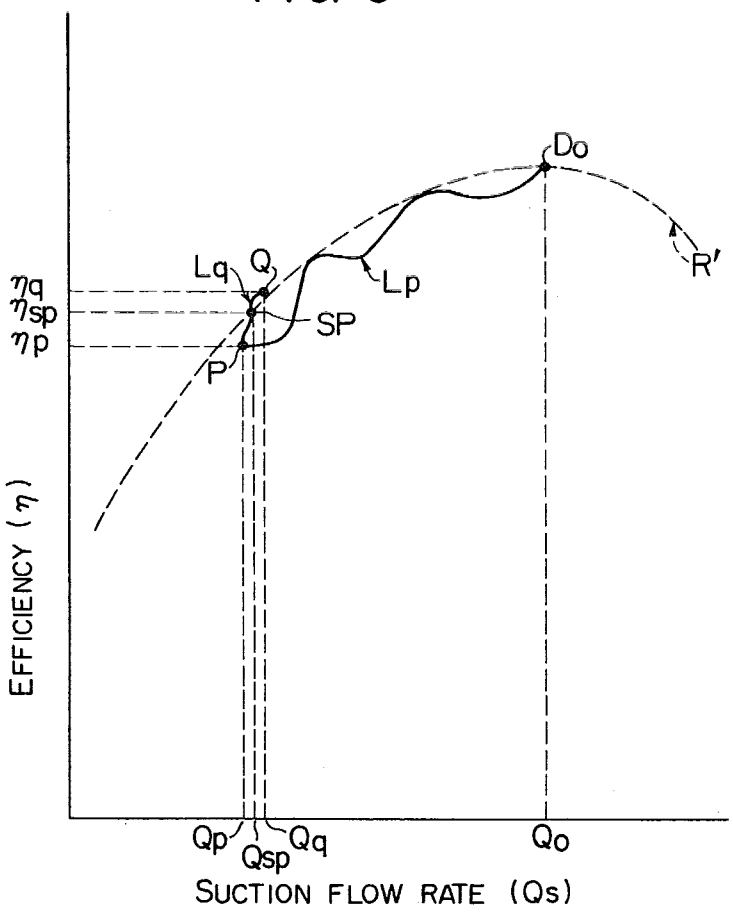
FIG. 5 is a view in explanation of the condition of operation of the centrifugal compressor equipment controlled by the method of control according to the invention.

FIG. 5 shows the manner in which the flow rate $Q_s$ and efficiency $\eta$ are controlled by the aforesaid series of control actions. In the diagram shown in FIG. 5, the abscissa represents the suction flow rate $Q_s$ and the ordinate indicates the efficiency $\eta$ as in FIG. 2, and predetermined operating conditions of the compressor equipment are indicated by the resistance curve R' of the load. A flow rate prevailing prior to effecting control is denoted by $Q_o$ and its operating point is indicated at $D_o$, while a desired flow rate is denoted by $Q_{sp}$ and its operating point is indicated at SP. In this state, amounts of operation are selected from the data in the control table in accordance with the flow rate to which the current flow rate shifts before reaching the desired flow rate as the flow rate varies, and the vanes are controlled based on these amounts of operation. Thus the operating point moves along the resistance curve R' and its path of movement is substantially as represented by a curve Lp.

Assume that the aforesaid control actions are taken according to this control process and equation (1) holds when the operating point of a flow rate has reached a point P. Generally, there is no great difference in efficiency $\eta sp$ achieved at point SP and efficiency $\eta p$ achieved at point P. However, to achieve increased efficiency in operation, the exploratory control actions described in detail by referring to FIG. 3 are practiced following the control actions described hereinabove. In the exploratory control actions, the angles at which the vanes are set for point P are successively adjusted and the operating point shifts from point P in a direction in which efficiency is increased, until the control actions are terminated at a point Q at which efficiency $\eta q$ is achieved. In this series of control actions, the process of effecting fine adjustments of the amount of operation and ascertaining of an increase in efficiency must be followed before the operating point shifts from P to Q. Thus a long period of time elapses before point Q is reached. However, a desired flow rate Qp is achieved following the movement of the operating point from P to Q along a curve Lq and the operating point moves at all times in a direction in which efficiency is increased irrespective of occurences of disturbances of any sort and variations in load resistance. Also, the maintenance of operation at high efficiency ensures that control is effected stably and positively.

The method of control according to the invention has been described with particular emphasis on control actions and the elements required for practicing the method. Control could be effected with increased effects by using an electronic computer as the control 32. The invention has been described as being incorporated in compressor equipment of four stages, but is not limited to this specific number of stages.

The embodiment described hereinabove relates to capacity or flow rate control, and pressure control can be effected in similar fashion according to the invention. Also, in the embodiment shown and described hereinabove, all the inlet guide vanes and diffuser vanes are controlled. However, it is possible to control flow rate by controlling only those vanes which have effective amount of operation, such as inlet guide vanes.

As described in detail, the method of control according to the invention enables the operating conditions of compressor equipment, such as flow rate, to promptly attain the desired level in conformity with a change in the applied load, and enables the efficiency of operation to be increased following the attainment of the desired operating conditions. Thus incorporation of the control method according to the invention in the operation of multistage compressor equipment provided with inlet guide vanes and diffuser vanes at each stage permits increased efficiency in operation to be achieved over a large range of operating conditions, thereby making it possible to operate the compressor equipment at a low energy consumption level.

What is claimed is:

1. A method of controlling multistage centrifugal compressor equipment having inlet guide vanes and diffuser vanes mounted at each stage in variable angle position, the method comprising the steps of:

determining which one of a range of operating conditions near the desired operating conditions and a range of operating conditions remote from the desired operating conditions the prevailing operating conditions of the compressor equipment are in; and controlling a combination of the amount of operation of the inlet guide vanes with the amount of operation of the diffuser vanes, which is determined beforehand, along an operating line of the compressor equipment so as to bring the prevailing operating conditions to the range of operating conditions near the desired operating conditions when the prevailing operating conditions are determined to be in the range of operating conditions remote from the desired operating conditions, and effecting fine adjustments of the inlet guide vanes and diffuser vanes to shift the efficiency of operation to a higher level within a range that the prevailing operating conditions do not deviate from the desired operating conditions when the prevailing operating conditions are determined to be in the range of operating conditions near the desired operating conditions.

2. A method of control as claimed in claim 1, wherein said control of the combination of the amount of operation of the inlet guide vanes with the amount of operation of the diffuser vanes when the prevailing operating conditions are determined to be in a range of operating conditions remote from the desired operating conditions is controlled in accordnace with operating conditions to which the prevailing operating conditions shift moment by moment until the prevailing operating conditions attain the level of desired operating conditions.

3. A method of control as claimed in claim 1, wherein the inlet guide vanes and the diffuser vanes when the prevailing operating conditions are determined to be in the range of operating conditions near the desired operating conditions are operated and controlled while searching operating conditions having a higher efficiency to obtain a higher efficiency.

* * * * *